United States Patent [19]

Ode et al.

[11] 4,255,801

[45] Mar. 10, 1981

[54] ELECTRONIC WATCH

[75] Inventors: Sadao Ode, Houyd; Toshikazu Hatuse, Tanashi, both of Japan

[73] Assignee: Citizen Watch Co. Ltd., Tokyo, Japan

[21] Appl. No.: 27,022

[22] Filed: Apr. 4, 1979

Related U.S. Application Data

[63] Continuation of Ser. No. 816,943, Jul. 19, 1977, abandoned.

[30] Foreign Application Priority Data

Jul. 26, 1976 [JP] Japan ..... 51/88898
Jul. 28, 1976 [JP] Japan ..... 51/90067

[51] Int. Cl.[3] ..... G04B 47/00; A44C 5/14; G04B 37/00

[52] U.S. Cl. ..... 368/1 D; 364/705; 368/282; 368/313

[58] Field of Search ..... 58/4 A, 23 R, 23 BA, 58/38 R, 38 A, 39, 50 R, 53–56, 88 R, 88 WC, 88 SC, 125 B, 126 A, 152 R, 152 A, 152 B; 364/705; 368/10, 29, 30, 62, 82, 83, 84, 282, 313

[56] References Cited

U.S. PATENT DOCUMENTS

| | | | |
|---|---|---|---|
| 3,971,206 | 7/1976 | Martino | 58/88 R |
| 4,028,509 | 6/1977 | Zurcher | 58/152 R |
| 4,095,412 | 6/1978 | Burke | 58/23 BA |

*Primary Examiner*—Edith S. Jackmon
*Attorney, Agent, or Firm*—Sherman & Shalloway

[57] ABSTRACT

An electronic watch comprising a timepiece circuit consisting of a reference oscillation source, a frequency divider and a display driving circuit, a display device connected to an output of said timepiece circuit, a power supply driving said timepiece circuit, an external actuator operating said timepiece circuit from the exterior of the watch, an outer case consisting of a case and a band, and a flexible hinge making the case integral with the band whereby there may be provided a useful and functional watch which is small in size and thin, and have no shortcoming such as a tendency for disconnection and erroneous wiring.

4 Claims, 2 Drawing Figures

ELECTRONIC WATCH

This is a continuation of application Ser. No. 816,943, filed July 19, 1977 now abandoned.

BACKGROUND OF THE INVENTION

1. Field of the Invention

This invention relates to an electronic watch and particularly to the electronic watch in which a case is made integral with a band in a body by means of a flexible hinge.

2. Description of the Prior Art

Recent development of integrated circuitery technology has enabled timepiece field to be rapidly advanced in adoption of electronics. Thus watches have been miniaturized, adopted to multiple functions and increased in longevity enough to be put to practical use. There have also been developed wristwatches provided with an electro-optical display device such as liquid crystal, light emission diode and electrochromic substance to digitally indicate the time. Along with the improvement of integrated circuit there has been miniaturization and adoption of multiple functions, and long durability, can be attained in practical use.

For example, the life of a battery cell has usually reached to two years when used in crystal oscillation-type digital wristwatch in which a liquid crystal is used to display the time. Electronic-type table calculators have been miniaturized and adopted to multiple functions together with developement of integrated circuits like the above-mentioned wristwatches. Thus small-powered display devices such as liquid crystal have been frequently utilized as display devices.

However conventional electronic timepieces including digital and analogue watches have been limited in miniaturization and thinness since each of electronic components is mounted on a watch case only. Some watches have been proposed in which electrical components are mounted on a band, but they have a significant possibility of disconnection and erroneous wiring since electrical interconnections in the case and band are made by means of wire-bonding etc.

SUMMARY OF THE INVENTION

Primary object of the present invention is to provide an electronic watch which eliminates the above defects.

Another object of the present invention is to provide an electronic watch which is thin in thickness and small in size.

Other object of the present invention is to provide an electronic watch which has no possibility of erroneous wiring and is elevated in reliability.

Further other object of the present invention is to provide an electronic watch which is light in weight, excellent in mass production and low in cost.

Still further object of the present invention is to provide an electronic timepiece which allows variation design.

According to one aspect of the invention there is provided an electronic watch comprising a timepiece circuit consisting of a reference oscillation source, a frequency divider and a display driving circuit, a display device connected to the output of the timepiece circuit, power supply driving the timepiece circuit, an external actuator operating the timepiece circuit from the exterior of the watch, an outer casing of a watch case and a band enclosing watch components therein and a flexible hinge making the case integral with the band.

PREFERRED EMBODIMENT OF THE INVENTION

Figure 1:
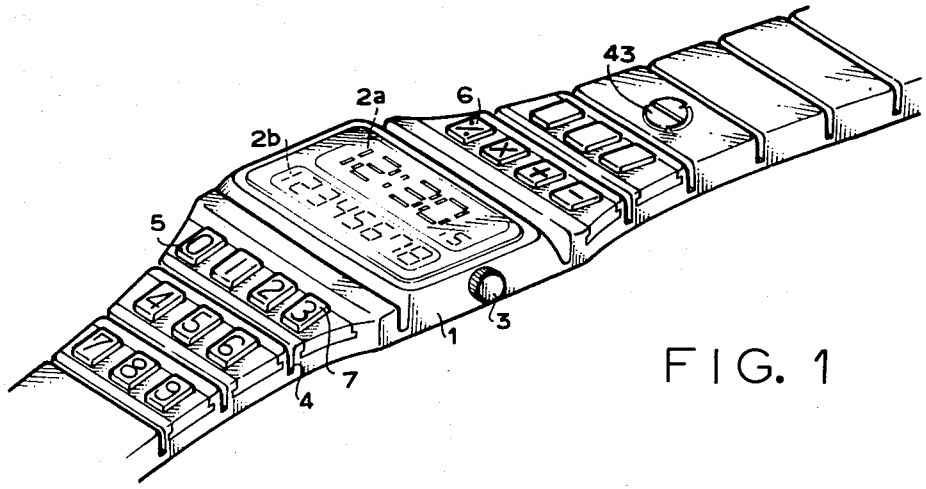
FIG. 1 shows a perspective view of a preferred embodiment of a multi-function timepiece according to the invention.

FIG. 1 is a perspective view of an electronic watch showing one embodiment of this invention in which reference numeral 1 depicts a watch case on which there are a time display 2*a* and a computation display 2*b*. An external actuator 3 is arranged on the side wall of the watch case 1 to externally actuate an internal timepiece circuit. The watch case 1 is connected to a band 5 by means of a flexible hinge. On the band 5 there is provided function keys 6 and numeral keys 7 etc. The watch case 1 is made of high molecular weight material with weather durability and flexibility such as polypropylene. As is apparent from the drawing the watch case 1 is coupled to the band 5 provided with portions to receive various kinds of operation keys through the flexible hinge 4 and arranged so as to fit one's hand for wearing it. The band 5 is divided into plural sections in view point of function and design, each section being coupled to each other by means of hinges 4.

Figure 2:
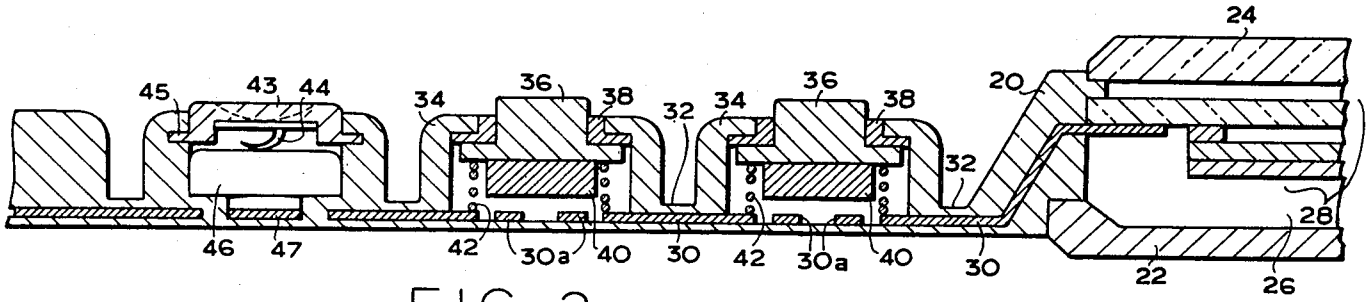
FIG. 2 shows details of the flexible hinge with a battery cell and hinge connected to a watch body in accordance with the invention.

FIG. 2 is an enlarged section of a watch case and band of the watch according to this invention in which reference numeral 20 denotes a watch case which is sandwiched with a back casing 22 and a viewing crystal 24 so as to form a receiving space 26 receiving a module (not shown) and a display device 28 therein. Reference numeral 32 illustrates a hinge 32 connecting the watch case 20 with a band 34. A conductive film strip 20 is patterned and arranged inside of the watch casing 20 and the band 34 in a longitudinal direction. Operating keys 36 are provided at each section of the band 34 and are biased upwards by means of springs 42. Reference numeral 38 indicates a cover for the key 36 and a conductive member 40 is secured to the pushing face so as to contact the pattern 30*a* when the key 36 is depressed and thereby closing a circuit. Namely the conductive film strip 30 is formed with a conductive pattern to deliver an input signal of the operation key 36 and for example, depression of the operation key 36 causes the conductive member 40 formed in a body therewith to compulsorily contact the pattern 30*a* so that a circuit is closed and a signal may be delivered. The band 34 is formed in one body in a suitable length (not shown) and both ends thereof are arranged to be connected with each other by means of a triple-folded metal member as is common with watch bands. The display device 28 is secured directly to the pattern 38*a* on the conductive film strip 30 by soldering or other suitable ways like other electric components of the watch.

Reference numeral 43 depicts a cap for a battery cell 46 as a power supply of the watch. The cap 43 is provided with a spring 44 on the lower side thereof for biasing the cell 46 downward and further with bayonet 45 at the periphery thereof. The spring 45 serves to bias the battery cell 46 against the electrode 47 on the conductive film strip 30 upon the receipt thereof. The spring 44 is connected as one electrode to a circuit (not shown). The battery cell cap 43 may be a screw-on type. Of course a watch of the present invention is not limited to a digital type watch and may be an analogue type watch.

According to the present invention there can be obtained advantages that there is provided a watch which is thin, is not prone to disconnection and erroneous wiring and further is elevated in reliability.

What is claimed is:

1. An electronic watch with a calculation function comprising:

(a) a timepiece circuit having a reference oscillation source, a frequency divider and a time display driving circuit;

(b) a computation circuit for performing the calculation function having a computation display driving circuit;

(c) a display device connected to said time display driving circuit and said computation display driving circuit for displaying a time and a calculation solution;

(d) an external operating member controlling said timepiece circuit and said computation circuit;

(e) an outer casing comprising a case and a band;

(f) an integral flexible hinge connecting said case and said band such that said case is integral with said band;

(g) a conductive patterned film sheet integrally located within said flexible hinge, said case and the band;

(h) a power supply source supplying energy through said conductive patterned film sheet to said timepiece circuit and said computation circuit; and (i) the electronic watch wherein said flexible hinge, said band and said case are comprised of an integral portion of a high molecular weight polymer which has a narrow region located between said case and said band which flexes and functions as said flexible hinge.

2. The electronic watch as claimed in claim 1 wherein further said band is provided with operation keys delivering a timepiece signal and a computation signal.

3. The electronic watch as claimed in claim 2 wherein said conductive patterned film sheet electrically connects said display device and said operation keys.

4. The electronic watch as claimed in claims 1 or 3 wherein the high molecular weight polymer is polypropylene.

* * * * *